US009110416B2

(12) United States Patent
Uchiyama et al.

(10) Patent No.: US 9,110,416 B2
(45) Date of Patent: Aug. 18, 2015

(54) IMAGE HEATING DEVICE AND PRESSING ROLLER FOR USE WITH THE IMAGE HEATING DEVICE

(75) Inventors: Koji Uchiyama, Boise, ID (US); Hisashi Nakahara, Numazu (JP); Yutaka Sato, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 701 days.

(21) Appl. No.: 13/186,546

(22) Filed: Jul. 20, 2011

(65) Prior Publication Data

US 2012/0020709 A1 Jan. 26, 2012

(30) Foreign Application Priority Data

Jul. 24, 2010 (JP) ..... 2010-166577

(51) Int. Cl.
*G03G 15/20* (2006.01)

(52) U.S. Cl.
CPC ..... *G03G 15/206* (2013.01); *G03G 15/2057* (2013.01)

(58) Field of Classification Search
CPC ..... G03G 15/206; G03G 15/2053; G03G 15/2057
USPC ..... 399/333
See application file for complete search history.

(56) References Cited

U.S. PATENT DOCUMENTS

| | | | | |
|---|---|---|---|---|
| 5,149,941 | A | 9/1992 | Hirabayashi et al. | |
| 5,300,997 | A | 4/1994 | Hirabayashi et al. | |
| 5,343,280 | A | 8/1994 | Hirabayashi et al. | |
| 5,767,484 | A | 6/1998 | Hirabayashi et al. | |
| 6,459,878 | B1 | 10/2002 | Tomoyuki et al. | |
| 6,546,223 | B2 | 4/2003 | Kishino et al. | |
| 7,171,148 | B2 * | 1/2007 | Mitsuoka et al. | 399/328 |
| 7,200,355 | B2 | 4/2007 | Uchiyama et al. | |
| 7,203,438 | B2 | 4/2007 | Omata et al. | |
| 7,650,105 | B2 | 1/2010 | Ogawa et al. | |
| 2002/0028736 | A1 | 3/2002 | Kishino et al. | |
| 2011/0236090 | A1 | 9/2011 | Uchiyama et al. | |

FOREIGN PATENT DOCUMENTS

| | | | |
|---|---|---|---|
| EP | 1 431 842 | A1 | 6/2004 |
| JP | 63-313182 | A | 12/1988 |

(Continued)

OTHER PUBLICATIONS

European Search Report dated Nov. 23, 2011, in counterpart European Application No. 11174824.0-2209.

(Continued)

*Primary Examiner* — David Gray
*Assistant Examiner* — Andrew V Do
(74) *Attorney, Agent, or Firm* — Fitzpatrick, Cella, Harper & Scinto

(57) ABSTRACT

An image heating device for heating a toner image while nip-conveying a recording material, in a nip, on which the toner image is carried, includes a heating member; and a pressing roller, including an elastic layer, for forming the nip in contact with the heating member. The elastic layer of the pressing roller includes a thermosetting silicon rubber containing a thermal conductive filler. The thermosetting silicon rubber includes pore portions formed with resin microballoons and a pore connecting portion for connecting the pore portions. The elastic layer has a thermal conductivity of 0.15 W/mK to 0.5 W/mK.

11 Claims, 3 Drawing Sheets

(56) References Cited

FOREIGN PATENT DOCUMENTS

| | | | |
|---|---|---|---|
| JP | 2002-070838 | A | 3/2002 |
| JP | 2002-082550 | A | 3/2002 |
| JP | 2002-148988 | A | 5/2002 |
| JP | 2009-103882 | A | 5/2009 |

OTHER PUBLICATIONS

Chinese Office Action dated Aug. 2, 2013, in counterpart Chinese Application No. 201110205608.4, and English-language translation thereof.

* cited by examiner (A)

(B)

IMAGE HEATING DEVICE AND PRESSING ROLLER FOR USE WITH THE IMAGE HEATING DEVICE

FIELD OF THE INVENTION AND RELATED ART

The present invention relates to an image heating device suitable when it is used as a fixing device to be mounted in an image forming apparatus such as an electrophotographic copying machine or an electrophotographic printer.

As the fixing device to be mounted in the electrophotographic copying machine or printer, the fixing device including a heater which includes a ceramic substrate and an electric heat generating element formed on the substrate, a fixing film movable in contact with the heater, and a pressing roller for forming a nip between the pressing roller and the fixing film contacted to the heater. A recording material for carrying an unfixed toner image is heated while being nip-conveyed in the nip of the fixing device, so that the toner image on the recording material is heat-fixed on the recording material. This fixing device has the advantage such that the time required from the start of energization to the heater until the temperature of the heater is increased up to a fixable temperature is short. Therefore, the printer in which the fixing device is mounted can shorten the time from input of a print instruction to output of an image on a first sheet of the recording material (FPOT: first printout time). Further, the fixing device of this type has also the advantage such that power consumption during stand-by in which the printer awaits the print instruction is less.

In the fixing device using the fixing film, in order to form the nip with a predetermined width with respect to a recording material conveyance direction, the pressing roller having an elastic layer is used. The elastic layer used for the pressing roller can be roughly classified into a sponge type in which pore portions are provided inside the elastic layer and a solid type in which the pore portions are not provided inside the elastic layer. Japanese Laid-Open Patent Application (JP-A) 2002-148988 discloses the elastic layer, of the sponge type in which the pore portions are not provided inside the elastic layer, used as the elastic layer used for the pressing roller.

In the fixing device using the fixing film, in general, the pressing roller is rotated by a driving motor and then the fixing film is rotated by being caused to follow the rotation of this pressing roller. In the printer in which this fixing device is mounted, it has been known that when a small-sized recording material is subjected to continuous printing with the same printing interval as that for a large-sized recording material, an area (non-sheet-passing area) of the heater in which the recording material is not passed in excessively increased in temperature.

The above non-sheet-passing portion temperature rise occurs on not only the heater but also the pressing roller. Particularly, a high heat resistant silicone rubber is principally used for the elastic layer used in the pressing roller but when the pressing roller is used for a long time at a temperature of, e.g., 230-240° C., deterioration of the elastic layer proceeds. This non-sheet-passing portion temperature rise on the pressing roller is more liable to occur with respect to the sponge type elastic layer with high heat insulating property, so that the temperature of the pressing roller at the non-sheet-passing portion is liable to become high. This is because it takes much time to diffuse heat of the pressing roller at the non-sheet-passing portion into other portions due to the heat insulating property of the elastic layer. On the other hand, in the solid type elastic layer including no pore portions therein, a thermal conductivity was higher than that of the sponge type elastic layer and therefore the solid type elastic layer was advantageous to reduce a degree of the non-sheet-passing portion temperature rise. However, the solid type elastic layer is accompanied with such a problem that a degree of thermal expansion is large.

The pressing roller receives the heat from the heater during a period in which the recording material does not enter the nip, thus being heated. By this heat from the heater, the elastic layer of the pressing roller causes the thermal expansion. The sponge type elastic layer includes the pore portions therein, and therefore when compared with a solid type elastic layer having the same volume, the amount of the elastic layer is small. Further, in the case where the pore portions present inside the sponge type elastic layer are not partitioned by walls of the elastic layer but are connected (in an open cell state), heat dissipation occurs from the inside of the elastic layer. For these reasons, the degree of the thermal expansion of the sponge type elastic layer is smaller than that of the solid type elastic layer.

Particularly, in the case of the fixing device of the type in which the pressing roller is driven by the motor and the fixing film is rotated by the rotation of the pressing roller, when the elastic layer causes the thermal expansion to increase the circumferential length of the pressing roller, the recording material conveyance speed in the nip becomes higher than a predetermined recording material reference conveyance speed.

When the recording material conveyance speed fluctuates depending on a change in circumferential length of the pressing roller, the influence thereof appears also on an image to be heat-fixed on the recording material. For example, the recording material conveyance speed in the nip becomes higher than the recording material reference conveyance speed, so that the recording material can be pulled toward conveying members (transfer roller and a conveying roller located upstream of the transfer roller) located upstream of the nip with respect to the recording material conveyance direction. In this case, the impact when the recording material has passed through the respective conveying members becomes large, so that such a problem that the large impact appears on the image as a horizontal line occurs. This horizontal line appearing on the image is referred to as blur.

An occurrence of the blur is assumed and in order to reduce the fluctuation in recording material conveyance speed when the elastic layer of the pressing roller is thermally expanded, e.g., an outer diameter of the pressing roller is set at a small value. Then, now conversely, the recording material conveyance speed in a cooled state of the pressing roller becomes slower than that of each of the conveying members located upstream of the nip with respect to the recording material conveyance direction. In this state, conversely, the recording material is in a state such that it can be pushed back from the nip, so that there can arise the problem that the density of the image, such as a halftone image, becomes high. This problem is referred to as trailing end density increase. Thus, due to the fluctuation in recording material conveyance speed in the nip, the problems as described above occur.

SUMMARY OF THE INVENTION

A principal object of the present invention is to provide an image heating device capable of reducing both of the degree of the non-sheet-passing portion temperature rise and the fluctuation in recording material conveyance speed in a nip and capable of realizing speeding up of a image heating process.

Another object of the present invention is to provide a pressing roller for use with the image heating device.

According to an aspect of the present invention, there is provided an image heating device for heating a toner image while nip-conveying a recording material, in a nip, on which the toner image is carried, the image heating device comprising:

a heating member; and a pressing roller, including an elastic layer, for forming the nip in contact with the heating member, wherein the elastic layer of the pressing roller includes a thermosetting silicon rubber containing a thermal conductive filler, wherein the thermosetting silicon rubber includes pore portions formed with resin microballoons and a pore connecting portion for connecting the pore portions, and wherein the elastic layer has a thermal conductivity of 0.15 W/mK to 0.5 W/mK.

According to another aspect of the present invention, there is provided a pressing roller for use with an image heating device, comprising:

an elastic layer, wherein the elastic layer includes a thermosetting silicon rubber containing a thermal conductive filler, wherein the thermosetting silicon rubber includes pore portions formed with resin microballoons and a pore connecting portion for connecting the pore portions, and wherein the elastic layer has a thermal conductivity of 0.15 W/mK to 0.5 W/mK.

According to the present invention, it is possible to provide an image heating device capable of reducing both of the degree of the non-sheet-passing portion temperature rise and the fluctuation in recording material conveyance speed in the nip, and capable of realizing speeding up of the image heating process. Further, it is also possible to provide a pressing roller for use with the image heating device.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Part (A) of FIG. 1 is a schematic structural view of an example of an image forming apparatus, and part (B) of FIG. 1 is a schematic cross-sectional structural view of a fixing device according to Embodiment 1.

Part (A) of FIG. 2 is a schematic cross-sectional view of a pressing roller of the fixing device according to Embodiment 1, and part (B) of FIG. 2 is a schematic cross-sectional view of a pressing roller of a fixing device according to Embodiment 2.

Figure 3:
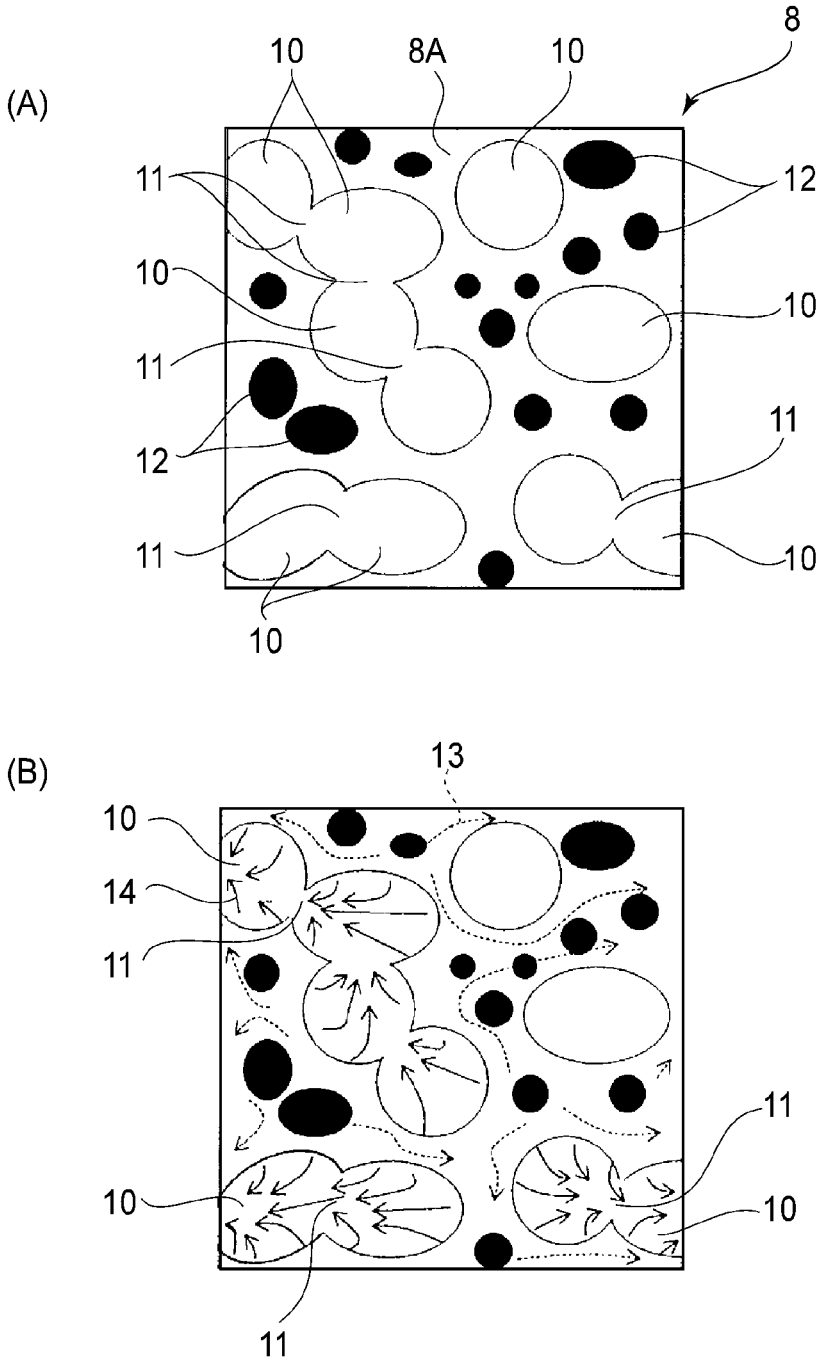

Part (A) of FIG. 3 is a partly enlarged cross-sectional view of a balloon rubber of a thermosetting silicone rubber constituting the pressing roller of the fixing device according to Embodiment 1, and part (B) of FIG. 3 is a partly enlarged cross-sectional view showing flow of heat in the balloon rubber.

DESCRIPTION OF THE PREFERRED EMBODIMENTS

Embodiment 1

Figure 1:
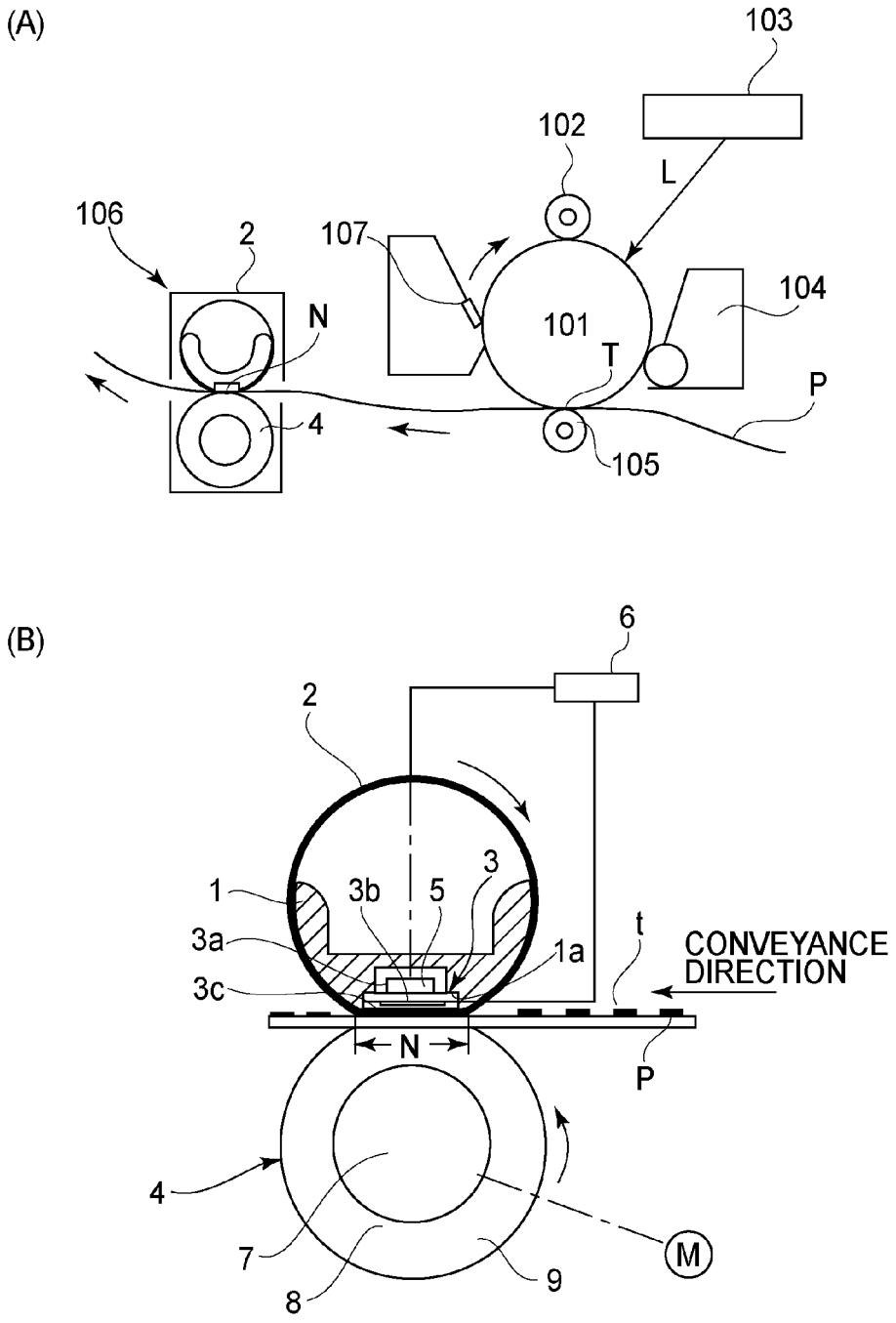

Part (A) of FIG. 1 is a schematic structural view of an example of an image forming apparatus in which an image heating device according to the present invention is mounted as a fixing device. This image forming apparatus is a laser printer of an electrophotographic type.

The image forming apparatus in this embodiment includes an electrophotographic photosensitive member (hereinafter referred to as a photosensitive drum) 101 as an image bearing member. The photosensitive drum 101 is prepared by forming a photosensitive layer of OPC, amorphous Se, amorphous Si or the like on an outer peripheral surface of a cylindrically shaped substrate of a metal material such as aluminum or nicked. The photosensitive drum 101 is rotated in an arrow direction at a predetermined peripheral speed (process speed) depending on a print instruction from an external device (not shown) such as a host computer. A predetermined charging bias is applied to a charging roller (charging member) 102, so that the outer peripheral surface of the photosensitive drum 101 is uniformly charged to a predetermined polarity and a predetermined potential. The charged surface of the photosensitive drum 101 is subjected to scanning exposure to a laser beam L, which is ON/OFF controlled depending on image information from the external device, by a scanning exposure device (exposure means) 103. As a result, an electrostatic latent image (electrostatic image) depending on the image information is formed on the charged surface of the photosensitive drum 101. A developing device (developing means) 104 deposits a toner on the latent image on the surface of the photosensitive drum 101 by a predetermined developing method, thus developing the latent image as a toner image (developer image).

To a transfer portion T between the surface of the photosensitive drum 101 and an outer peripheral surface of a transfer roller (transfer member) 105, a recording material P such as recording paper or an OHP sheet is conveyed with predetermined timing. Then, the recording material P is nipped between the surface of the photosensitive drum 101 and the surface of the transfer roller 105 and is (nip-) conveyed in that state. In a conveying process of this recording material P, a predetermined transfer bias is applied to the transfer roller 105, so that the toner image is transferred from the surface of the photosensitive drum 101 onto the recording material P and is carried on the recording material P.

The recording material P on which the unfixed toner image is carried passes through a fixing nip N, described later, of a fixing device 106, so that the unfixed toner image is heat-fixed on the surface of the recording material P. The recording material P coming out of the fixing nip N is discharged on a discharge tray (not shown). The surface of the photosensitive drum 101 after the toner image transfer is cleaned by a drum cleaner (cleaning member) 107, so that the photosensitive drum 101 is subjected to next image formation.

Part (B) of FIG. 1 is a schematic cross-sectional view of the fixing device. This fixing device is of a film heating type. The fixing device of the film heating type uses an endless belt-like or cylindrical fixing film. Further, at least a part of the fixing film at a circumferential portion is tension free (in a state no tension is applied), so that the fixing device is constituted so that the fixing film is rotated by a rotational driving force of a pressing roller.

In the following description, with respect to the fixing device and members constituting the fixing device, the longitudinal direction refers to a direction perpendicular to a recording material conveyance direction on the surface of the recording material. The widthwise direction refers to a direction parallel to the recording material conveyance direction on the surface of the recording material. The A length refers to a dimension with respect to the longitudinal direction. The width refers to a dimension with respect to the widthwise direction. The width direction refers to a direction perpendicular to the recording material conveyance direction on the surface of the recording material. The length direction refers to a dimension with respect to the width direction.

The fixing device 106 in this embodiment includes a cylindrical heat resistant fixing film (heating member) 2 and a ceramic heater (heat generating member) 3 for heating the fixing film 2. Further, the fixing device 106 in this embodiment includes a heater holder (heat generating element supporting member) 1, in a substantially semicircular trough shape, for supporting a ceramic heater 3 and includes a pressing roller (pressing member) 4 and the like. These members are elongated members extending in the longitudinal direction. Inside the fixing film 2, the heat holder 1 is provided, so that the fixing film 2 is heated from an inner peripheral surface side by the ceramic heater 3. The diameter of the fixing film 2 is 18 mm. The inner circumferential length of the fixing film 2 is made larger than the outer circumferential length of the heat holder by about 3 mm, so that the fixing film 2 is externally engaged with the heat holder 1 with an allowance with respect to the circumferential length.

The heat holder 1 can be constituted by high heat resistant resin materials such as polyimide, polyamideimide, PEEK, PPS and liquid crystal polymer; composite materials of these resin materials with ceramics, metal, glass and the like; etc. In this embodiment, the heater holder 1 was constituted by using the liquid crystal polymer. The heater holder 1 is supported at its longitudinal end portions by a (fixing) device frame (not shown) of the fixing device 106 via flanges (not shown) for preventing movement in the longitudinal direction.

The ceramic heater 3 supported by a groove portion 1*a* provided at a lower surface of the heater holder 1 includes an elongated ceramic-made heater substrate 3*a* ((b) of FIG. 1). On a substrate surface (front surface) of the heater substrate 1*a* at the fixing film 2 side, an energization heat generating layer 3*b* on which a heat generating paste is printed is formed along the longitudinal direction of the heater substrate 3*a*. To this heat generating layer 3*b*, electric energy is supplied from an energization controller 6 through an electric energy supply electrode (not shown) provided inside and at longitudinal end portions of the heater substrate 3*a*. In order to ensure protection of the heat generating layer 3*b* and an insulating property between the heat generating layer 3*b* and the fixing film 2, a glass layer as an insulating layer 3*c* is coated on the surface of the heat generating layer 3*b*.

As the fixing film 2, in order to improve a quick start property, a single-layer film, which is formed to have a thickness of 100 μm or less, preferably 50 μm or less, and 20 μm or more, and is formed of a heat resistant material such as PTFE, PFA or FEP, can be used. Alternatively, it is possible to use a composite layer film prepared by coating a layer of PTFE, PEA, FEP or the like on the outer peripheral surface of a film of polyimide, polyamideimide, PEEK, PES, PPS or the like. In this embodiment, as the fixing film 2, the composite layer film having a three-layer structure consisting of a cylindrical base layer, a primer layer provided on the outer peripheral surface of the base layer and a surface layer provided on the outer peripheral surface of the primer layer is used. The fixing film 2 is constituted by an about 60 μm-thick base layer of polyimide, an about 10 μm-thick surface layer of PFA coating and an about several μm-thick primer layer formed between the base layer and the surface layer.

The pressing roller 4 includes a metal core (supporting member) 7 as a shaft (axis), an elastic layer 8 provided on the outer peripheral surface of the core metal 7, a parting layer (outermost layer) 9 provided on the outer peripheral surface of the elastic layer 8, and the like. Further, the pressing roller 4 is supported rotatably and vertically movably by the device frame via bearings (not shown) at longitudinal end portions of the metal core 7. Further, the bearings are urged toward the fixing film 2 in a radial direction of the pressing roller 4 by urging springs (not shown) with a predetermined urging force. As a result, the outer peripheral surface of the pressing roller 4 is contacted to the outer peripheral surface of the fixing film 2, so that the pressing roller 4 is urged toward the heater 3 in the contact state. Thus, the elastic layer 8 of the pressing roller 4 is elastically deformed, so that a fixing nip N with a predetermined width is formed between the fixing film 2 surface and the pressing roller 4 surface.

In the entire area of the fixing nip N, a restoring force by which the elastic layer 8 of the pressing roller 4 is to be restored to an original shape before the elastic deformation is exerted as nip pressure. In the pressing roller 4 in this embodiment, an iron core as the metal core 7, a silicone rubber layer as the elastic layer 8, and an about 50 μm-thick PFA tube as the parting layer 9 were used. The pressing roller 4 is 20 mm in outer diameter and the elastic layer 8 is about 3 mm in thickness. The urging force of the urging springs for urging the pressing roller 4 toward the fixing film 2 is 147 N (15 kgf). The width of the fixing nip N is 7 mm.

In the fixing device 106 in this embodiment, a fixing motor (driving source) M is rotationally driven depending on a print instruction. The rotational force of an output shaft of the fixing motor M is transmitted to the metal core 7 of the pressing roller 4 via a predetermined gear train (drive transmission mechanism), so that the pressing roller 4 is rotated in an arrow direction at a predetermined peripheral speed (process speed). The rotational force of the pressing roller 4 is transmitted to the fixing film 2 in the fixing nip N by a frictional force between the pressing roller 4 surface and the fixing film 2 surface, so that the fixing film 2 is rotated in an arrow direction by the rotation of the pressing roller 4 while being contacted to the insulating layer 3*c* of the heater 3 at its base layer. Further, depending on the print instruction, the energization controller 6 supplies the electric energy to the heat generating layer 3*b* via the electric energy supply electrode of the heater 3, so that the heat generating layer 3*b* generates heat and thus the heater 3 is quickly increased in temperature to heat the fixing film 2. The temperature of the heater 3 is detected by a temperature detecting element (temperature detecting member) 5 such as a thermistor provided on a substrate surface (back surface) of the heater substrate 3*a* at a side opposite from the heat generating layer 3*b* side. The energization controller 6 obtains (reads) a temperature detection signal (output signal) outputted from the temperature detecting element 5 and on the basis of this temperature detection signal, controls the energization to the heat generating layer 3*a* so as to maintain the temperature of the heater 3 at a predetermined fixing temperature (target temperature). In a state in which the fixing motor M is rotationally driven and the energization to the heat generating layer 3*a* of the heater 3 is controlled, the recording material P on which an unfixed toner image t is carried is introduced into the fixing nip N with a toner image carrying surface upward. The recording material P is nipped in the fixing nip N between the fixing film 2 surface and the pressing roller 4 surface and is then conveyed (nip-conveyed) in the nipped state. In this conveying process, the toner image t is heated and melted by the heater 3 via the fixing film 2 and is supplied with the nip pressure, so that the toner image t is heat-fixed on the surface of the recording material P.

Figure 2:
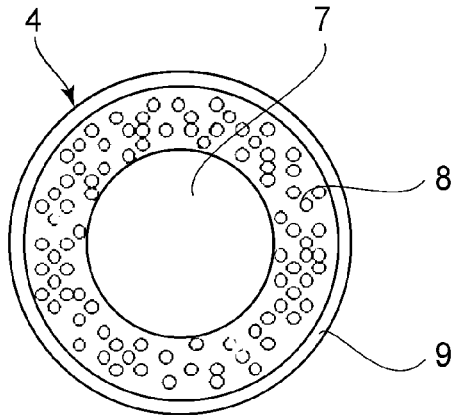
Figure 2:
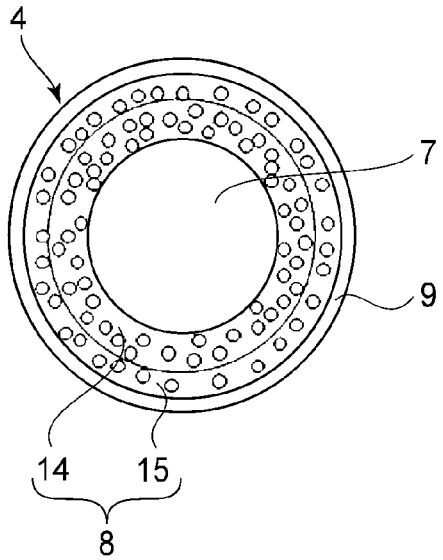

Part (A) of FIG. 2 is a schematic cross-sectional view of the pressing roller of the fixing device in this embodiment. The elastic layer 8 is a sponge-like rubber composition including resin microballoons and a high thermal conductive filler selected from at least one of seven types of high thermal conductive fillers of metal silicon, alumina, zinc oxide, silica, magnesium oxide, silicon carbide and graphite. The material of the elastic layer 8 is not particularly limited when the elastic layer 8 is adjusted to provide a thermal conductivity in a range of 0.15 W/mK to 0.5 W/mK and a rubber hardness in a range of 15 degrees to 50 degrees as measured by an Asker C hardness meter. The elastic layer 8 described in this embodiment is the sponge-like rubber composition constituted by the resin microballoons and therefore the elastic layer 8 which is the sponge-like rubber composition is referred to as a balloon rubber.

The balloon rubber in this embodiment will be described more specifically. The resin microballoons used in this embodiment are those ("Matsumoto Microsphere F series", mfd. by Matsumoto Yushi-Seiyaku Co., Ltd.) and are microcapsules each having an average particle size of 20-30 μm and each prepared by encapsulating a low boiling point hydrocarbon in a thermoplastic polymer shell. Hereinafter, the low boiling point hydrocarbon is referred to as a hydrocarbon. The thermoplastic polymer shell is referred to as a shell. The resin microballoons have an small average particle size of 20-30 μm as described above in an environment in which the temperature of the hydrocarbon inside the shell is 40° C. The resin microballoons are heated, so that the hydrocarbon inside the shell is expanded and the shell is enlarged by internal pressure. Thus, the hydrocarbon portions have a shape of 80-500 μm in particle size. In this embodiment, the resin microballoons heated and dried for 1 hour in an oven set at 90° C. and are were cooled. Thereafter, the resin microballoons are left standing for 50 minutes in the oven set at 140° C., so that expanded resin microballoons, in which the hydrocarbon portions each encapsulated in the shell had the average particle size of 150 μm. are obtained.

The resin microballoons are cooled and then mixed (kneaded) and dispersed in a liquid silicone rubber material. The liquid silicone rubber material may be a silicone rubber material, which assumes liquid at room temperature and is hardened by applying heat thereto to possess rubber-like elasticity, i.e., a thermosetting silicone rubber and the types or the like of the liquid silicone rubber material are not particularly limited. In this embodiment, as the liquid silicone rubber material, "DY35-561A/B" (viscosity: 130 Pa·s, specific gravity: 1.17 is used and a balloon rubber material is obtained by performing the mixing (kneading) and dispersion of the resin microballoons.

Next, the high thermal conductive filler to be added in the balloon rubber material will be described. As the high thermal conductive filler used in this embodiment, any material is usable when the material is generally used in order to enhance the thermal conductivity of the silicone rubber. Particularly, as the high thermal conductive filler, the filler selected from those of metal silicon, alumina, zinc oxide, silica, magnesium oxide, silicon carbide and graphite is suitable as the high thermal conductive filler. These fillers have the thermal conductivities in the range of 20-350 W/mK, which are sufficient for improving the thermal conductivity of the silicone rubber. Further, the fillers have specific gravities in the range of about 2.0 to about 4.0 and less and cause precipitation due to a difference in specific gravity when the fillers are added in the liquid silicone rubber, thus being liable to be dispersed.

Further, the shape of the high thermal conductive filler may be spherical, a scale-like shape, or the like and is not particularly limited. However, the filler having a needle-like shape can provide a high thermal conductivity in a small addition amount but it is relatively difficult to effect compounding (formulation) control in order to bring the thermal conductivity into a desired thermal conductivity range and therefore caution is required.

The average particle size of the high thermal conductive filler may desirably be in the range of 2-50 μm. When the average particle size is less than 2 μm, it becomes difficult to form a path for heat conduction by control of the fillers, so that there arises a need to increase the addition amount. On the other hand, when the average particle size exceeds 50 μm, it is difficult to incorporate the high thermal conductive filler into a silicone rubber wall for forming pore portions with the resin microballoons. As a result, the silicone rubber itself for forming the pore portions is in a state in which the silicone rubber is separated by the filler, thus causing a problem such that strength is impaired. Further, in order to achieve the preferable thermal conductivity range (0.15 W/mK to 0.5 W/mK) of the balloon rubber of the pressing roller 4, it is preferable that the filler having the average particle size in the range of 10 μm to 30 μm.

Next, various characteristics of the pressing roller obtained by a combination of the resin microballoons and the thermal conductive filler will be described.

When the thermal conductivity of the balloon rubber is less than 0.15 W/mK, the temperature rise speed at the pressing roller surface becomes high, so that the fixing device temperature can be increased more quickly up to a predetermined fixing temperature. This is important for realizing quick print out particularly in an image forming apparatus in which preheating of the fixing film and the pressing roller is not effected during stand-by (hereinafter referred to as on-demand fixing). However, in the case of low thermal conductivity such that the thermal conductivity of the elastic layer 8 is less than 0.15 W/mK<, the degree of the non-sheet-passing portion temperature rise becomes large when a small-sized recording material, which is smaller than a large-sized recording material, which can be passed (introduced) in the fixing nip, is passed (introduced) in the fixing nip. For this reason, the pressing roller is required to possess a higher heat resistant property. Further, when the thermal conductivity of the balloon rubber exceeds 0.5 W/mK, the temperature rise of the pressing roller becomes slow, so that the rising speed of the fixing device is impaired.

Further, when the rubber hardness of the balloon rubber exceeds 50 degrees as measured by the Asker C hardness meter, it becomes difficult to form the fixing nip with the desired nip width. For this reason, the rubber hardness of the balloon rubber may preferably be 50 degrees or less, more preferably be 40 degrees or less. Further, when the rubber hardness of the balloon rubber as measured by the Asker C hardness is less than 15 degrees, the degree of deterioration of the silicone rubber with use is large, so that there is a possibility of breakage of the silicone rubber within the lifetime of the product. For this reason, the rubber hardness of the balloon rubber may preferably be 15 degrees or more, and more preferably may be 20 degrees or more. The measurement of the rubber hardness of the balloon rubber is performed by using a test piece of the silicone rubber. The shape of the test piece is not particularly limited except for the thickness. Two sheet-like test pieces each having the thickness of 6 mm were subjected to the measurement in a superposed state. A load for the measurement was 9.8N (1000 g-weight).

With respect to the necessary nip width in the fixing nip, there is a need to bring the heat generating layer of the heater into the nip width and there is the case where the nip width varies depending on the process speed, so that a value of an optimum nip width is different for each of the printers used.

However, generally, when the nip width is narrowed, there is a tendency that the fixing strength of the toner on the recording material (recording paper) deteriorates and from the viewpoint of design latitude, it is preferable that a wider nip width as large as possible is obtained.

In order to obtain the desired nip width by using the pressing roller including the balloon rubber having a rubber hardness which exceeds 50 degrees, there is a need to bring the pressing roller and the fixing film into contact with each other under the application of high pressure. As a result, a possibility of the occurrence of problems, such as the instability of the rotational movement property, resulting in breakage of the fixing film, and the increase in the pressure exerted on the bearing portions of the pressing roller, causing abrasion of the bearings, becomes high. Therefore, the rubber hardness of the balloon rubber may preferably be 15 degrees to 50 degrees as measured by the Asker C hardness meter.

Next, it is preferable that a large number of pore portions formed into the balloon rubber by the resin microballoons are not independent of each other but are connected to each other. In order to connect the pore portions in the balloon rubber, the number of pore portions formed by the resin microballoons and pore connecting portions, which are formed by vaporization of a vaporizable component contained in the silicone rubber, for connecting those pore portions, are provided in the balloon rubber.

As the vaporizable component for connecting the resin microballoon pore portions by being vaporized, the following component is preferred. That is, a component that has a good affinity for the resin microballoons, which have already been expanded, and that has a poor affinity for the silicone rubber, and further that is vaporized at a temperature not less than a softening temperature or melting temperature of the resin for the resin microballoons, is preferred. The vaporizable component may desirably be at least one species of compounds selected from the group consisting of ethylene glycol, diethylene glycol, triethylene glycol, and glycerin.

In this embodiment, as the vaporizable component, ethylene glycol is selected and is added when the resin microballoons and metal silicon are kneaded. Further, a step is added in which the heating was effected at a temperature of 200° C. or more after the heat curing to break the microballoon shape of the resin microballoons, thus completing formation of the pore connecting portions for connecting the pore portions.

The compounding amounts of the resin microballoons and the high thermal conductive filler are changed depending on the desired thermal conductivity and the hardness of the balloon rubber. In 100 wt. parts of the liquid silicone rubber, 1-10 wt. parts of the resin microballoons and 1-60 wt. parts of the high thermal conductive filler may preferably be added. When the amount of the resin microballoons is less than 1 wt. part, the balloon rubber is in a state close to the solid rubber and thus a sufficient heat resistant property cannot be obtained, so that it becomes difficult to connect the microballoons to each other. In the case where the amount of the resin microballoons exceeds 10 wt. parts, the viscosity of the liquid silicone rubber material is increased, so that it becomes difficult to effect the mixing and stirring. When the amount of the high thermal conductive filler is less than 1 wt. part, the thermal conductivity of the silicone rubber cannot be sufficiently increased. When the amount of the high thermal conductive filler exceeds 60 wt. parts, the hardness of the silicone rubber is increased, so that it becomes difficult to obtain a desired rubber hardness. Further, the strength of the silicone rubber wall, which forms the pore portions with the microballoons, is decreased, so that the degree of the durability of the silicone rubber is lowered.

Next, a forming method of the pressing roller 4 will be described. The silicone rubber material is formed on the other peripheral surface of the metal core 7 by the heat curing at a temperature that is not more than a heat expansion temperature of the resin microballoons. The means or method for heat-curing the silicone rubber material to form the roller is not limited, but such a method that the metal-made core is mounted on a pipe-like metal mold having a predetermined inner diameter and then the silicone rubber material is injected into the metal mold, followed by heating of the metal mold to form the roller, is simple and suitable.

A partly enlarged cross-sectional view of the balloon rubber formed with the thermosetting silicone rubber as described above is shown in (A) of FIG. 3. As shown in (A) of FIG. 3, in a thermosetting silicone rubber 8A which is a matrix of the balloon rubber, a large number of pore portions 10 of about 100 μm to about 150 μm are contained. These pore portions 10 are formed with the resin microballoons. Further, a part of the pore portions 10 is broken, so that adjacent pore portions 10 are connected through the pore connecting portion 11. On the other hand, inside the thermosetting silicone rubber 8A which is the matrix of the balloon rubber, a thermal conductive filler 12 of about 10-30 μm in size is contained. In this embodiment, as the thermal conductive filler 12, metal silicon is added.

Part (B) of FIG. 3 is a schematic view showing flow of heat in the balloon rubber. In (B) of FIG. 3, an arrow 13 represents the principal motion of heat flow in the thermosetting silicone rubber 8A. The heat supplied to the balloon rubber can be transferred along the thermosetting silicone rubber 8A, which is the matrix of the balloon rubber. The speed of this heat transfer is increased by metal silicon as the thermal conductive filler 12. The heat is transferred more quickly, so that it is possible to suppress the non-sheet-passing portion temperature rise.

An arrow 14 represents the flow of the air in the pore portions 10. The adjacent pore portions 10 formed inside the thermosetting silicone rubber 8A are connected through the pore connecting portions 11 and are further connected to the outside of the thermosetting silicone rubber 8A. Then, the air inside the pore portions 10 is heated and expanded by the heat from the inner wall of the thermosetting silicone rubber 8A, so that the pressure in the pore portions 10 is increased. By this pressure, the air is pushed from the connected pore portions 10 to the outside of the thermosetting silicone rubber 8A so that the heat of the air is also exhausted together with the air to the outside of the thermosetting silicone rubber 8A.

By convection of the air inside the pore portions 10 and a decrease in amount of the thermosetting silicone rubber 8A by the presence of the pore portions 10, the thermal expansion of the balloon rubber is suppressed.

By using the above-constituted pressing roller, a comparative experiment was conducted with respect to a conventional pressing roller as an object to be compared. The comparative experiment will be described below.

First, as the pressing roller in this embodiment, the pressing roller including the balloon rubber layer in which metal silicon was added as the thermal conductive filler was prepared. In 100 wt. parts of the liquid silicone rubber, 5 wt. parts of the already-expanded resin microballoons, as the resin microballoons, of 150 μm in average particle size, 20 wt. parts of the metal silicon filler, as the high thermal conductive filler, of 20 μm in average particle size and 4 wt. parts of ethylene glycol were mixed. Then, in the metal mold, at 130° C., heat-curing molding was conducted. As the resin microballoons, those (trade name: "F80-ZD", mfd. by Matsumoto Yushi-Seiyaku Co., Ltd.) were used. As the liquid silicone rubber, that (trade name: "DY35-561A/B", mfd. by Dow Corning Toray Co., Ltd.) was used. Then, the pressing roller was heated and treated for 2 hours in the oven kept at 230° C., so that the resin microballoons were partly broken and the pore connecting portions for connecting the pore portion were formed.

As a result, a balloon rubber pressing roller containing the high thermal conductive filler and having the thermal conductivity of about 0.3 W/mK was obtained. The thermal conductivity was measured by a surface thermal conductivity meter (trade name: "QTM-500", mfd. by Kyoto Electronics Manufacturing Co., Ltd.). The thermal conductivity of the balloon rubber layer was measured by bringing a sensor probe (Model: "PD-11", mfd. by Kyoto Electronics Manufacturing Co., Ltd.) of the surface thermal conductivity meter into contact to the pressing roller surface in parallel to the axial direction (longitudinal direction) of the pressing roller. The above-prepared pressing roller is hereinafter referred to as that in Embodiment 1-1.

Further, in Embodiments 1-2 to 1-5, pressing rollers variously changed in compounding amount of the resin microballoons and the high thermal conductive filler were prepared and the thermal conductivity was measured.

In Embodiment 1-2, in 100 wt. parts of the liquid silicone rubber, 4.3 wt. parts of the resin microballoons and 3 wt. parts of metal silicon as the high thermal conductive filler were added. As a result, the pressing roller having the thermal conductivity of 0.15 W/mK was obtained.

In Embodiment 1-3, in 100 wt. parts of the liquid silicone rubber, 4.5 wt. parts of the resin microballoons and 9 wt. parts of metal silicon as the high thermal conductive filler were added. As a result, the pressing roller having the thermal conductivity of 0.20 W/mK was obtained.

In Embodiment 1-4, in 100 wt. parts of the liquid silicone rubber, 5.4 wt. parts of the resin microballoons and 30 wt. parts of metal silicon as the high thermal conductive filler were added. As a result, the pressing roller having the thermal conductivity of 0.40 W/mK was obtained.

In Embodiment 1-5, in 100 wt. parts of the liquid silicone rubber, 6 wt. parts of the resin microballoons and 42 wt. parts of metal silicon as the high thermal conductive filler were added. As a result, the pressing roller having the thermal conductivity of 0.50 W/mK was obtained.

Next, in Comparative embodiments 1 and 2, pressing rollers variously changed in compounding amount of the resin microballoons and the high thermal conductive filler were prepared and the thermal conductivity was measured.

In Comparative embodiment 1, in 100 wt. parts of the liquid silicone rubber, 4 wt. parts of the resin microballoons were added. Metal silicon as the high thermal conductive filler was not added. As a result, the pressing roller having the thermal conductivity of 0.12 W/mK was obtained.

In Comparative Embodiment 2, in 100 wt. parts of the liquid silicone rubber, 6.4 wt. parts of the resin microballoons and 53 wt. parts of metal silicon as the high thermal conductive filler were added. As a result, the pressing roller having the thermal conductivity of 0.60 W/mK was obtained.

By using 7 types in total of the pressing rollers in Embodiments 1-1 to 1-5 and Comparative embodiments 1 and 2, the comparative experiment with respect to the non-sheet-passing portion temperature rise and the rising speed of the fixing device was conducted.

An evaluation was performed in the following manner of the non-sheet-passing portion temperature rise, which is a phenomenon such that the temperature of the heater in an area through which the recording material did not pass (non-sheet-passing area) increases. This experiment was conducted by incorporating the fixing device in each embodiment into the image forming apparatus in which a sheet conveyance speed (recording material conveyance speed) was about 202 mm/sec.

A4-sized paper having a basis weight of 128 g/m2 was set at a sheet feeding port and then 500 sheets of the paper were continuously passed through the fixing device. A thermocouple was contacted to the pressing roller end portion surface and the temperature of the pressing roller surface was monitored. This experiment was conducted in the state in which the fixing device in each embodiment was incorporated into the image forming apparatus (sheet conveyance speed: 202 mm/sec).

The position in which the thermocouple is contacted is an exactly intermediate position between a position in which a widthwise end portion of the A4-sized paper (recording material) passes through and an end position of a longitudinal heating area of the heater. This intermediate position is a point at which the degree of the non-sheet-passing portion temperature rise becomes largest.

In this experiment, the heater of 220 mm in length of the heat generating element was used. This heater is disposed so that a position through which a widthwise center position of the A4-sized paper passes and a center position of the heat generating element coincide with each other and therefore each of a length from the heater center position to one longitudinal end of the heater and a length from the heater center position to the other longitudinal end of the heater is 110 mm. The widthwise length of the A4-sized paper is 210 mm and therefore each of a length from the A4-sized paper center position to one widthwise end of the A4-sized paper and a length from the A4-sized paper center position to the other widthwise end of the A4-sized paper is 105 mm. Therefore, the heat generating element is in a state in which it is protruded from each of the widthwise ends of the A4-sized paper by 5 mm. At a center position of an area of 5 mm in which the heat generating element is protruded, i.e., at a point, on the surface of the pressing roller, corresponding to the position with a length of 2.5 mm from the widthwise end of the A4-sized paper, the thermocouple was disposed in contact with the pressing roller.

Further, evaluation of the fixing device rising speed (the a time from the start of energization to the heat generating element of the heater until the temperature of the heater reaches a predetermined temperature) was performed by monitoring a temperature rise speed of the temperature detecting element provided on the back surface of the heater substrate. Specifically, the image forming apparatus was connected to a commercial power source of 120 V, so that electric power was supplied to the heater. The resistance of the heater was adjusted to set the heater so as to consume the power of about 800 W at the voltage of 120 V. In a laboratory set at 25° C., after the temperature (25° C.) was equal to room temperature, the heater was energized and the fixing device motor was rotationally driven, so that the pressing roller and the fixing film were placed in a rotation state. The time in which the heater temperature was increased from 25° C. up to 200° C. was monitored, so that the rising speed was evaluated.

Evaluation results of the non-sheet-passing portion temperature rise and the rising speed are summarized in Table 1.

TABLE 1

| EMB. | TC*1 (W/mK) | TR*2 (° C.) | 200° C.-TIME*3 (sec) |
|---|---|---|---|
| COMP. EMB. 1 | 0.12 | 239 | 4.0 |
| EMB.1-2 | 0.15 | 230 | 4.2 |
| EMB.1-3 | 0.20 | 225 | 4.5 |
| EMB.1-1 | 0.30 | 220 | 5.0 |
| EMB.1-4 | 0.40 | 212 | 6.0 |
| EMB.1-5 | 0.50 | 205 | 7.5 |
| COMP. EMB. 2 | 0.60 | 200 | 11.0 |

*1"TC" represents the thermal conductivity (W/mK).

*2"TR" represents the non-sheet-passing portion temperature rise, i.e., the temperature (° C. 9 at the non-sheet-passing portion.

*3"200° C.-TIME" represents a time (sec) required for increasing the heater temperature from 25° C. to 200° C.

In Embodiment 1-1, the non-sheet-passing portion was 220° C. The heat resistant temperature of the thermosetting silicone rubber is about 230° C. and when the pressing roller is used for a long time at this temperature, there is a possibility that the thermosetting silicone rubber deteriorates. In Embodiment 1-1, the non-sheet-passing portion temperature rise was 220° C. and therefore was in a range that causes no problem. Further, the 200° C.-TIME (the time required for increasing the heater temperature from 25° C. to 200° C.) was 5.0 sec. In the case where the 200° C.-TIME is about 5.0 sec, even when the energization to the fixing device is effected simultaneously with the print start, the heater temperature becomes a fixable temperature before the A4-sized paper on which the unfixed toner image is carried reaches the fixing nip. For this reason, there is no need for the user to await the print out, so that the 200° C.-TIME is the rising time, causing no problem, for realizing the on-demand fixing.

In Comparative embodiment 1, the non-sheet-passing portion temperature rise reached 239° C. In this experiment, the breakage of the thermosetting silicone rubber was not caused but the temperature is such that the deterioration of the thermosetting silicone rubber can occur at the temperature, so that it cannot be said that the pressing roller has a preferred characteristic. Further, in Comparative embodiment 2, the non-sheet-passing portion temperature rise was 200° C. which was good but the 200° C.-TIME was 11 sec. During the rising of the fixing device, the thermal conductivity of the pressing roller is high and the heat is taken by the pressing roller, so that the temperature rise of the heater becomes slow. For that reason, the time required until the print out becomes long. It would be considered that a user advantage is enhanced when the waiting time for the print out is 10 sec. or less at the latest. From this viewpoint, the pressing roller in Comparative embodiment 2 is not suitable. On the other hand, in Embodiments 1-2, 1-3, 1-4 and 1-5, similarly as in Embodiment 1-1, the results of both of the non-sheet-passing portion temperature rise and the rising speed of the fixing device were within practical ranges.

From the above experiment, it was found that by realizing the thermal conductivity within the range of 0.15 W/mK to 0.50 W/mK with respect to the elastic layer 8 of the pressing roller, it was possible to provide the fixing device which compatibly realized prevention of the non-sheet-passing portion temperature rise and high-speed rising of the fixing device.

Next, an experiment for comparing expansion coefficients of six pressing rollers will be described.

The expansion coefficient of each pressing roller was evaluated by a method of measuring a speed of the recording paper (recording material) to be conveyed. In the neighborhood of a sheet discharging port of the image forming apparatus, a laser Doppler velocimeter (Model: "LV-20Z" (sensor portion: "S-100Z", signal processing unit: P-20Z") mfd. by Canon K.K.) was disposed and the conveyance speed of the recording paper to be discharged was directly measured by the velocimeter. As the recording paper, a letter (LTR)-sized plain paper with a basis weight of 75 g/m2 ("R4200" mfd. by Xerox Corp.) was used. In an intermittent print mode in which an operation of the fixing device from after one sheet printing, in a state in which the fixing device temperature was equal to room temperature, until start of subsequent printing (hereinafter referred to as a cold state) was stopped for 4 sec, the printing on 250 sheets was effected. At this time, the state of the fixing device is referred to as a hot state. In the intermittent print mode, for every printing on one sheet of the recording paper, the pressing roller and the fixing film are subjected to pre-rotation before the printing and post-rotation after the printing, thus being a print mode in which the pressing roller is liable to be heated by the heater. Therefore, with an increasing print number, the pressing roller was gradually heated, so that the expansion efficiency was gradually increased.

In this experiment, the conveyance speed of the first sheet of the recording paper, i.e., the conveyance speed of the recording paper by the pressing roller in the cold state and the conveyance speed of the 250-th sheet of the recording paper, i.e., the conveyance speed of the recording paper by the pressing roller in the hot state were measured and compared. A value obtained by the following equation was defined as the expansion coefficiency of the pressing roller.

Expansion coefficient (%)={(conveyance speed (mm/sec) of recording paper by pressing roller in hot state)/(conveyance speed (mm/sec) of recording paper by pressing roller in cold state)}×100-100.

Also in this experiment for comparing the expansion coefficients of the pressing rollers, comparative pressing rollers having the following constitutions were prepared in Comparative embodiments 3 and 4.

The pressing roller in Comparative embodiment 3 was prepared without adding ethylene glycol. That is, in 100 wt. parts of the liquid silicone rubber, 5 wt. parts of the already-expanded microballoons, as the resin microballoons, of 150 μm in average particle size and 20 wt. parts of the metal silicon filler, as the high thermal conductive filler, of 20 μm in average particle size were mixed. Then, in the metal mold, at 130° C., heat-curing molding was conducted. As the already-expanded microballoons, those (trade name: "F80-ZD", mfd. by Matsumoto Yushi-Seiyaku Co., Ltd.) were used. As the liquid silicone rubber, that (trade name: "DY35-561A/B", mfd. by Dow Corning Toray Co., Ltd.) was used. Then, the pressing roller was heated and treated for 2 hours in the oven kept at 230° C., so that the resin microballoons were partly broken and the pore connecting portions for connecting the pore portion were formed.

As a result, a balloon rubber pressing roller having the thermal conductivity of 0.3 W/mK identical to that in Embodiment 1 was obtained. When the state of the balloon rubber layer was observed through a microscope with a magnification of 200, the pore portions formed with the resin microballoons were observed but the pore connecting portions for connecting the pore portions were not formed, so that the pore portions formed with the resin microballoons were in a state in which the pore portions are independently present.

In Comparative embodiment 4, the pressing roller including the elastic layer formed with the solid rubber in which the microballoons were not added were prepared. That is, in 100 wt. parts of the liquid silicone rubber, 2.5 wt. parts of metal silicon as the high thermal conductive filler was added. As a result, the pressing roller having the thermal conductivity of 0.3 W/mK was obtained. When the elastic layer was observed through the microscope, the pore portions were not observed and it was confirmed that the elastic layer was a complete silicone rubber.

In addition to the results of Comparative embodiments 3 and 4 described above, the results of the comparative experiment including Comparative embodiment 1 and Embodiments 1-1, 1-2 and 1-5 described above are summarized in Table 2.

TABLE 2

| EMB. | EL*1 | BC*2 | TC*3 (W/mK) | SCS*4 (mm/sec) 1ST | SCS*4 (mm/sec) 250TH | PREC*5 (%) |
|---|---|---|---|---|---|---|
| EMB. 1-1 | B | YES | 0.30 | 201.7 | 206.4 | 2.3 |
| EMB. 1-2 | B | YES | 0.15 | 201.9 | 206.6 | 2.3 |
| EMB. 1-5 | B | YES | 0.50 | 202.3 | 207.0 | 2.3 |
| COMP. EMB. 1 | B | YES | 0.12 | 203.1 | 207.8 | 2.3 |
| EMB. 3 | B | NO | 0.30 | 202.0 | 209.3 | 3.6 |
| EMB. 4 | S | YES | 0.30 | 201.1 | 209.1 | 4.0 |

*1"EL" represents the elastic layer. "B" represents the balloon, and "S" represents the solid.
*2"BC" represents balloon connection. "YES" represents that the balloons are connected, and "NO" represents that the balloons are not connected.
*3"TC" represents the thermal conductivity (W/mK).
*4"SCS" represents the sheet conveyance speed (mm/sec). "1ST" represents the first sheet, and "250TH" represents the 250-th sheet.
*5"PREC" represents the pressing roller expansion coefficient (%).

First, the expansion coefficient of the elastic layer of the pressing roller of the balloon rubber in Embodiment 1-1 in which the thermal conductive filler was added was 2.3%. Further, the expansion coefficients in Embodiment 1-2 and 1-5 were also 2.3%. Next, the expansion coefficient of the elastic layer of the pressing roller in Comparative embodiment 3 in which the balloon rubber was used was 2.3%. Further, the expansion coefficient of the pressing roller in Comparative embodiment 3 in which the balloon rubber including the unconnected pressing rollers formed with the resin microballoons was used was 3.6%. The (thermal) expansion efficient of the elastic layer of the pressing roller in Comparative embodiment 4 in which the solid rubber was used was 4.0%.

In Embodiments 1-1, 1-2 and 1-5 and Comparative embodiment 1, the pore portions are provided in the elastic layers by the resin microballoons. As a result, e.g., compared with the solid rubber, the amount of the rubber can be decreased and the air convection from the connected pore portions to the outside of the thermosetting silicone rubber is caused, so that the heat can be exhausted to the outside of the thermosetting silicone rubber and therefore the pressing roller is less liable to be expanded.

In Comparative embodiment 3, although the pore portions are formed in the elastic layer by the resin microballoons, the respective pore portions are independently present. As a result, the air inside the thermosetting silicone rubber cannot be moved to the outside the thermosetting silicone rubber, so that the heat cannot be exhausted to the outside of the thermosetting silicone rubber. However, the amount of the silicone rubber portion having the large (thermal) expansion coefficient was smaller than that of, e.g., the solid rubber and therefore the (thermal) expansion coefficient was suppressed at a low level compared with the case of the Comparative embodiment 4.

In Comparative embodiment 4, the solid rubber in which the pore portions were not present was used as the elastic layer, thus resulting in the highest (thermal) expansion coefficient among those in this experiment.

From comparison between Embodiments 1-2 and 1-5, even in the case where the thermal conductivities of the elastic layers are different from each other, when each of the elastic layers has the structure in which the pore portions formed with the resin microballoons are present and are connected to each other, the same expansion coefficient is obtained. As a result, it was found that there is little influence of the thermal conductivity on the expansion coefficient.

When the expansion coefficient of the elastic layer is about 2.3%, the recording material conveyance speed by the pressing roller can be adjusted. That is, it is possible to adjust the recording material conveyance speed by the pressing roller so that the image inconvenience (such as the rear end density increase described above) caused due to the slow recording material conveyance speed of the pressing roller and the image inconvenience (such as the blur described above) caused due to the fast recording material conveyance speed of the pressing roller can be compatibly obviated. However, when the expansion coefficient of the elastic layer exceeds 3.0%, it becomes difficult to compatibly obviate the above two inconveniences. That is, in Comparative embodiments 3 and 4, in the case where the recording material conveyance speed of the pressing roller in the cold state is set at a speed causing no rear end density decrease, the blur occurs when the pressing roller is expanded in the hot state. On the other hand, when the recording material conveyance speed of the pressing roller is adjusted so as not to cause the blur in the hot state, the rear end density increase cannot be avoided in the cold state.

From the above results, it was found that the pressing roller in Embodiment 1-1 in which the thermal conductive filler-added balloon rubber was used and the pressing roller in Comparative embodiment 1 in which the balloon rubber was used had the same expansion coefficient. On the other hand, it was found that the expansion coefficient of the pressing roller using the solid rubber became large when compared with the balloon rubber.

From the above-described experiments, by using the balloon rubbers of 0.15 W/mK to 0.5 W/mK in thermal conductivity, it was found that the pressing rollers which did not impair the rising time and which are excellent in suppression of the non-sheet-passing portion temperature rise were able to be provided. Further, by using, as the elastic layer, the balloon rubber in which the pore portions formed with the resin microballoons are connected by the pore connecting portions, it was found that the thermal expansion of the pressing roller was able to be suppressed and it was possible to provide the pressing roller with less fluctuation in recording material conveyance speed.

As described above, by using the fixing device including the pressing roller 4 in this embodiment, it is possible to reduce both of the degree of the non-sheet-passing portion temperature rise and the fluctuation in the recording material conveyance speed in the fixing nip, so that the heat-fixing process of the image can be effected at a higher speed.

Embodiment 2

Another example of the fixing device will be described. The fixing device in this embodiment has the same constitution as that of the fixing device in Embodiment 1 except that the pressing roller different from that in Embodiment 1 is used. In this embodiment, members and portions identical to those of the fixing device in Embodiment 1 are represented by the same reference numerals or symbols and will be omitted from redundant description. A characteristic portion of the pressing roller in this embodiment will be described.

A schematic cross-sectional view of the pressing roller of the fixing device in this embodiment is shown in (B) of FIG. 2. In the pressing roller 4 in this embodiment, an iron core as the metal core 7, a silicone rubber layer the elastic layer 8 and an about 50 μm-thick PFA tube as the parting layer 9 are used.

Similarly in Embodiment 1, the elastic layer 8 in the pressing roller in this embodiment is also a sponge-like rubber composition including resin microballoons and a filler selected from at least one of metal silicon, alumina, zinc oxide, silica, magnesium oxide, silicon carbide and graphite. Also in this embodiment, similarly as in Embodiment 1, the elastic layer 8 which is the sponge-like rubber composition is referred to as a balloon rubber.

In this embodiment, the elastic layer 8 is divided into two layers consisting of a lower layer (center-side elastic layer portion with respect to a radial direction of the pressing roller) 14 at a metal core 17 side and an upper layer (surface-side elastic layer portion with respect to the radial direction of the pressing roller) 15 at a parting layer 9 side. In the lower layer 14 and the upper layer 15, the addition ratio between the resin microballoons and the thermal conductive filler is changed, so that the thermal conductivities are different from each other. However, the same addition amounts of the resin microballoons and the thermal conductive filler are used both in the case where the elastic layer is not divided into the two layers and the case where the elastic layer is divided into the two layers. That is, in the lower layer 14 in the case where the elastic layer is divided into the two layers, compared with the elastic layer in the case where the elastic layer is not divided into the two layers, the addition amount of the resin microballoons is made large. In the upper layer 15 in the case where the elastic layer is divided into the two layers, compared with the elastic layer in the case where the elastic layer is not divided into the two layers, the addition amount of the resin microballoons is made small. The addition amount of the thermal conductive filler is conversely, made small in the lower layer 14 in the case where the elastic layer is divided into the two layers compared with the elastic layer in the case where the elastic layer is not divided into the two layers and is made large in the upper layer 15 in the case where the elastic layer is divided into the two layers compared with the elastic layer in the case where the elastic layer is not divided into the two layers.

In this embodiment, as described above, by using the two types of the balloon rubber materials different in compounding ratio between the resin microballoons and the thermal conductive filler, the resultant thermal conductivity in the elastic layer with respect to the layer thickness direction is changed. The amount of the resin microballoons is larger and the amount of the thermal conductive filler is smaller at the portion close to the metal core 7, so that the elastic layer is more excellent in heat resistant property and has a low thermal conductivity. On the other hand, the amount of the resin microballoons is smaller and the amount of the thermal conductive filler is larger at the portion close to the parting layer 9, i.e., close to the pressing roller surface, so that the elastic layer has a high thermal conductivity.

By increasing the thermal conductivity in the neighborhood of the surface of the pressing roller 4 as in this embodiment (Embodiment 2), the surface temperature of the pressing roller 4 when the non-sheet-passing portion temperature rise occurs can be decreased. On the other hand, with respect to the total rubber amount of the elastic layer 8 which is the sum of the rubber amounts of the upper layer 15 and the lower layer 14, when the amount of the added resin microballoons is made equal to that in the case where the elastic layer is not divided into the upper layer and the lower layer as in Embodiment 1, the thermal expansion caused due to warming of the pressing roller 4 can be kept at the substantially same level.

As described above, the pressing roller 4 in which the elastic layer 8 is divided into the upper layer 15 and the lower layer 14 and in which the compounding ratio between the resin microballoons and the thermal conductive filler is changed as described above, is used for measuring the non-sheet-passing portion temperature rise and the thermal conductivity. The measuring methods are similar to those in Embodiment 1 and therefore will be omitted from description in this embodiment.

In the pressing roller 4 in this embodiment, a 3 mm-thick elastic layer 8 was divided into a 1.3 mm-thick upper layer 15 and a 1.7 mm-thick lower layer. This is because rubber volumes of the upper layer 15 and the lower layer 14 are made equal to each other. When the compounding ratio between the resin microballoons and the thermal conductive filler in the case where the elastic layer is not divided into the upper layer and the lower layer is 1, in the upper layer 15 of the elastic layer 8, the resin microballoons are added at the ratio of 0.8 and the thermal conductive filler is added at the ratio of 1.2. On the other hand, in the lower layer 14 of the elastic layer 8, the resin microballoons are added at the ratio of 1.2 and the thermal conductive filler is added at the ratio of 0.8.

In a comparative embodiment, the pressing roller in which the elastic layer was not divided into the upper layer and the lower layer was prepared and in which the compounding ratio between the resin microballoons and the thermal conductive filler was 1.0 was used. This comparative embodiment is Comparative embodiment 5. Results are summarized in Table 3.

TABLE 3

| EMB. | NSPPTR*1 (° C.) | PRTEC*2 (%) |
|---|---|---|
| EMB. 2 | 215.0 | 2.4 |
| COMP. EMB. 5 | 220.0 | 2.3 |

*1"NSPPTR" represents the non-sheet-passing portion temperature rise (° C.).
*2"PRTEC" represents the thermal expansion coefficient (%) of the pressing roller.

In the pressing roller in Embodiment 2, the non-sheet-passing portion temperature rise was 215° C. In the pressing roller in Comparative embodiment 5, the non-sheet-passing portion temperature rise was 220° C. and therefore, it was found that the degree of the non-sheet-passing portion temperature rise can be improved by increasing the thermal conductivity in the neighborhood of the pressing roller as in this embodiment. On the other hand, the thermal expansion coefficient was 2.4% for the pressing roller in Embodiment 2 and 2.3% for the pressing roller in Comparative embodiment 5. It would be considered that a pore density of each of the divided upper and lower layers is changed by the division to change a degree of expansion of each of the two layer and thus the resultant pressing roller is changed in thermal expansion coefficient from that in Comparative embodiment 5. However, when the thermal expansion coefficient is 2.5% or less, it is sufficiently possible to compatibly realize obviation of the inconveniences in the cases where the recording material conveyance speed is fast and slow and the change in thermal expansion coefficient is within a range of no problem. Therefore, it would be said that the thermal expansion coefficients in Embodiment 2 and Comparative embodiment 5 are the substantially same level.

As described above, it was found that the degree of the non-sheet-passing portion temperature rise at the pressing roller surface can be suppressed at a low level by changing the thermal conductivity of the elastic layer with respect to the layer thickness direction, e.g., by setting the thermal conductivity in the neighborhood of the pressing roller surface at a high level. On the other hand, it was also found that the thermal expansion coefficient is the same when the porosity of the resin microballoons is the substantially same and the fluctuation in recording material conveyance speed of the pressing roller can be suppressed at a low level.

Thus, by using the fixing device including the pressing roller 4 in this embodiment, it is possible to obtain the same action and effect as in those in Embodiment 1.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 166577/2010 filed Jul. 24, 2010, which is hereby incorporated by reference.

What is claimed is:

1. An image heating device for heating a toner image while nip conveying a recording material, in a nip, on which the toner image is carried, said image heating device comprising:

a heating member; and a pressing roller, including an elastic layer, configured to form the nip in contact with said heating member, wherein the elastic layer of said pressing roller includes a thermosetting silicone rubber containing a thermal conductive filler, wherein the thermosetting silicone rubber includes pore portions formed with resin microballoons and pore connecting portions configured to connect the pore portions, wherein the thermosetting silicone rubber is prepared by heat-curing a liquid silicone rubber obtained by adding 1-10 weight parts of the resin microballoons and 1-60 weight parts of the thermal conductive filler in 100 weight parts of the liquid silicone rubber, wherein the elastic layer has a thermal conductivity of 0.15 W/mK to 0.5 W/mK and a rubber hardness of 15-50 degrees as measured by an Asker C hardness meter, and wherein a density of the pore portions formed with the resin microballoons and an amount of addition of the thermal conductive filler in the thermosetting silicone rubber are different between a surface side portion and a center side portion in the thermosetting silicone rubber with respect to a radial direction of said pressing roller.

2. A device according to claim 1, wherein the thermal conductive filler of said pressing roller is selected from at least one of metal silicon, alumina, zinc oxide, silica, magnesium oxide, silicon carbide and graphite.

3. A device according to claim 1, wherein the thermal conductive filler of said pressing roller has an average particle size of 2-50 μm.

4. A image heating device according to claim 1, wherein the amount of addition of the thermal conductive filler in the surface side portion is larger than the amount of addition of the thermal conductive filler in the center side portion.

5. A image heating device according to claim 4, wherein the density of the pore portion formed with the resin microballoons in the center side portion is larger than the density of the pore portion formed with the resin microballoons in the surface side portion.

6. A pressing roller for use with an image heating device, comprising:

an elastic layer, wherein said elastic layer includes a thermosetting silicone rubber containing a thermal conductive filler, wherein the thermosetting silicone rubber includes pore portions formed with resin microballoons and a pore connecting portions configured to connect the pore portions, wherein the thermosetting silicone rubber is prepared by heat-curing a liquid silicone rubber obtained by adding 1-10 weight parts of the resin microballoons and 1-60 weight parts of the thermal conductive filler in 100 weight parts of the liquid silicone rubber, wherein the elastic layer has a thermal conductivity of 0.15 W/mK to 0.5 W/mK and a rubber hardness of 15-50 degrees as measured by an Asker C hardness meter, and wherein a density of the pore portions formed with the resin microballoons and an amount of addition of the thermal conductive filler in the thermosetting silicone rubber are different between a surface side portion and a center side portion in the thermosetting silicone rubber with respect to a radial direction of said pressing roller.

7. A roller according to claim 6, wherein the thermal conductive filler is selected from at least one of metal silicon, alumina, zinc oxide, silica, magnesium oxide, silicon carbide and graphite.

8. A roller according to claim 6, wherein the thermal conductive filler has an average particle size of 2-50 μm.

9. A roller according to claim 6, wherein the amount of addition of the thermal conductive filler in the surface side portion is larger than the amount of addition of the thermal conductive filler in the center side portion.

10. A image heating device according to claim 9, wherein the density of the pore portion formed with the resin microballoons in the center side portion is larger than the density of the pore portion formed with the resin microballoons in the surface side portion.

11. An image heating device for heating a toner image while nip conveying a recording material, in a nip, on which the toner image is carried, said image heating device comprising:

a heating member; and a pressing roller, including an elastic layer, configured to form the nip in contact with said heating member, wherein the elastic layer of said pressing roller includes a thermosetting silicone rubber containing a thermal conductive filler, wherein the thermosetting silicone rubber includes pore portions formed with resin microballoons and pore connecting portions configured to connect the pore portions, wherein the thermosetting silicone rubber comprises heat-cured liquid silicone rubber comprising 1-10 parts by weight of the resin microballoons and 1-60 parts by weight of the thermal conductive filler in 100 parts by weight of the liquid silicone rubber, wherein the elastic layer has a thermal conductivity of 0.15 W/mK to 0.5 W/mK and a rubber hardness of 15-50 degrees as measured by an Asker C hardness meter, and wherein a density of the pore portions formed with the resin microballoons and an amount of addition of the thermal conductive filler in the thermosetting silicone rubber are different between a surface side portion and a center side portion in the thermosetting silicone rubber with respect to a radial direction of said pressing roller.

* * * * *